United States Patent [19]

Daly et al.

[11] Patent Number: 4,971,254

[45] Date of Patent: Nov. 20, 1990

[54] THIN ORIFICE SWIRL INJECTOR NOZZLE

[75] Inventors: Paul D. Daly; John S. Welc, both of Troy, Mich.; David P. Wieczorek, Newport News, Va.; Sims B. Demere, Newport News, Va.; Ross W. Wood, Newport News, Va.

[73] Assignee: Siemens-Bendix Automotive Electronics L.P., Troy, Mich.

[21] Appl. No.: 442,096

[22] Filed: Nov. 28, 1989

[51] Int. Cl.[5] ..... F02M 51/06; F02M 61/12

[52] U.S. Cl. ..... 239/585; 239/533.12; 239/396

[58] Field of Search ..... 239/390, 396, 464, 487, 239/488, 489, 494, 497, 533.12, 585

[56] References Cited

U.S. PATENT DOCUMENTS 4,651,931 3/1987 Hans et al. ..... 239/585

4,923,169 5/1990 Grieb et al. ..... 239/585

*Primary Examiner*—Andres Kashnikow

*Assistant Examiner*—L. Morris

*Attorney, Agent, or Firm*—George L. Boller; Russel C. Wells

[57] ABSTRACT

The nozzle of a fuel injector is constructed to have a seat member and a single thin disc orifice member. A guide member affixed to the seat member guides the injector needle toward the seat in the seat member as the needle is reciprocated within the injector by pulsing the injector solenoid. Fuel is conveyed past the guide member by holes that are spaced radially outwardly from the central hole which guides the needle and that are skewed to the injector axis. As fuel passes through these skewed holes, it acquires angular momentum. The effect of this angular momentum is to increase the divergence of the column of fuel that is emitted by the single thin disc orifice member.

4 Claims, 3 Drawing Sheets

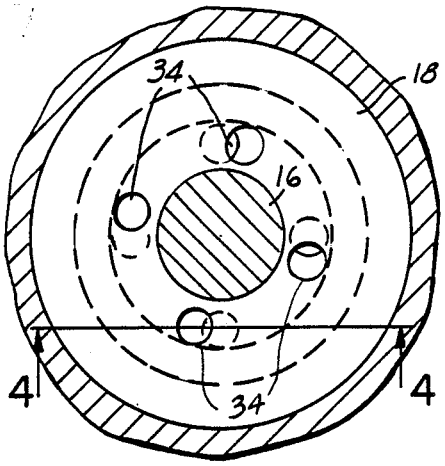
FIG.3
FIG.4
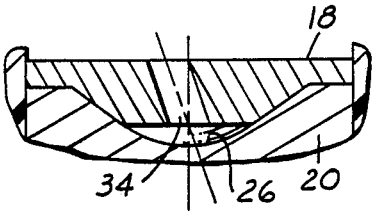
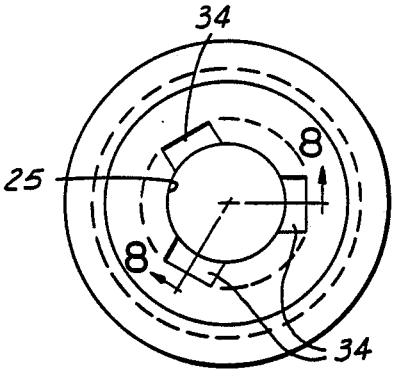
FIG.6
FIG.5
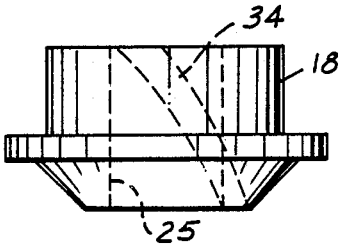
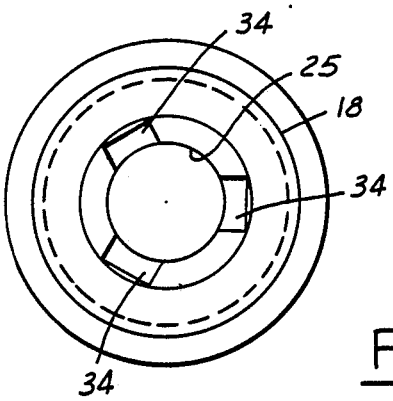
FIG.7

THIN ORIFICE SWIRL INJECTOR NOZZLE

BACKGROUND AND SUMMARY OF THE INVENTION

This invention relates to a fuel injector, particularly to the construction of the injector nozzle.

In a known type of fuel injector, the nozzle comprises a single thin orifice disc out of which the fuel is emitted. Within the nozzle, just upstream of the single thin orifice disc, is a valve seat member having a centrally located seat and hole for a needle that is operated by the injector's solenoid to open and close the hole. The needle is guided by means of a needle guide member that is assembled concentrically to the valve seat member. The needle guide member contains straight holes spaced outwardly of its needle guide hole, and these straight holes provide for the passage of fuel through the needle guide member. In this type of injector, the single thin orifice disc controls the static fuel flow because almost all the pressure drop occurs across it. Additionally, fuel atomization is enhanced since velocity is proportional to the square root of the pressure drop across the orifice. A further attribute of this type of fuel injector is that it is generally lift-insensitive. The typical fuel spray pattern from the valve is mostly a thin column that is surrounded by a fine cloud around the outside.

It has now been discovered that the spray pattern can be enhanced without sacrificing the aforementioned advantages of a single thin orifice disc injector. This is accomplished by making the fuel holes in the needle guide member skewed instead of straight. As fuel passes through the skewed holes, angular momentum is imparted to it. Even though the diameter of the metering orifice in the single thin orifice disc is much smaller in diameter than either the diameter on which the skewed holes lie or the diameter of the hole through the valve seat member, there is a significant angular momentum in the fuel that passes through the metering orifice so that the column of fuel that exits the nozzle has significantly increased divergence. The amount of divergence is a function of the specific design. This type of a spray pattern will generally be advantageous when the injector is used to spray fuel toward the intake valve of an internal combustion engine. Yet the injector requires no more parts than the known injector described above.

The foregoing features and advantages of the invention, along with additional ones, will be seen in the ensuing description and claims, which should be considered in conjunction with the accompanying drawings. The drawings disclose a preferred embodiment of the invention according to the best mode presently contemplated for carrying out the invention.

BRIEF DESCRIPTION OF THE DRAWINGS

FIG. 3 is a transverse cross sectional view taken in the direction of arrows 3—3 in FIG. 2.

FIG. 4 is a cross sectional view taken in the direction of arrows 4—4 in FIG. 3.

FIG. 5 is a view of another embodiment of one of the parts of the injector.

FIG. 6 is a top view of FIG. 5.

FIG. 7 is a bottom view of FIG. 5.

DESCRIPTION OF THE PREFERRED EMBODIMENT

Figure 1:
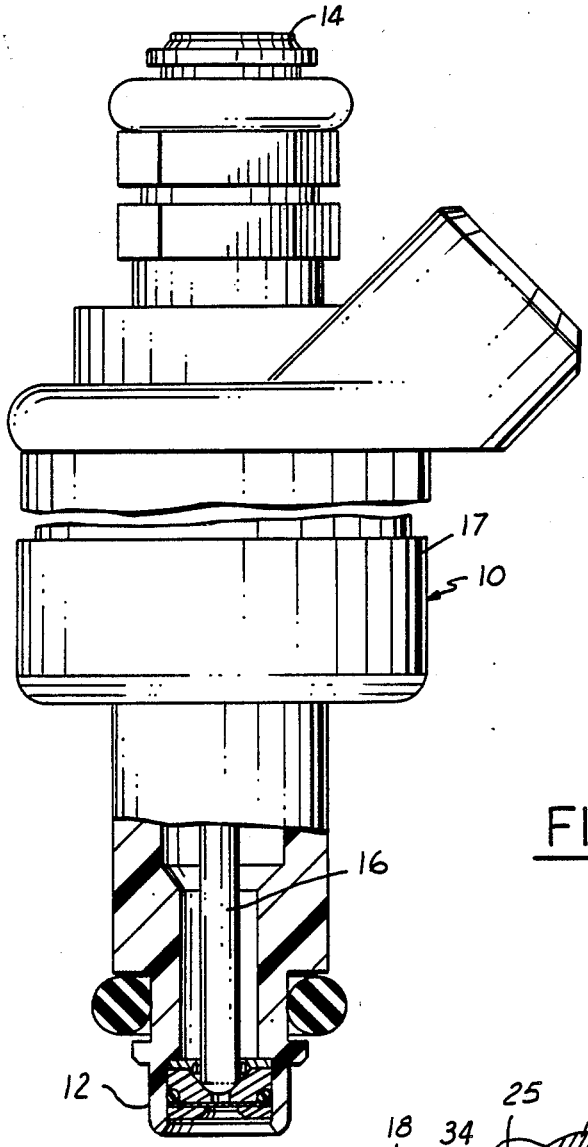
FIG. 1 is an elevational view, having portions sectioned away, showing a fuel injector constructed in accordance with principles of the invention.
Figure 2:
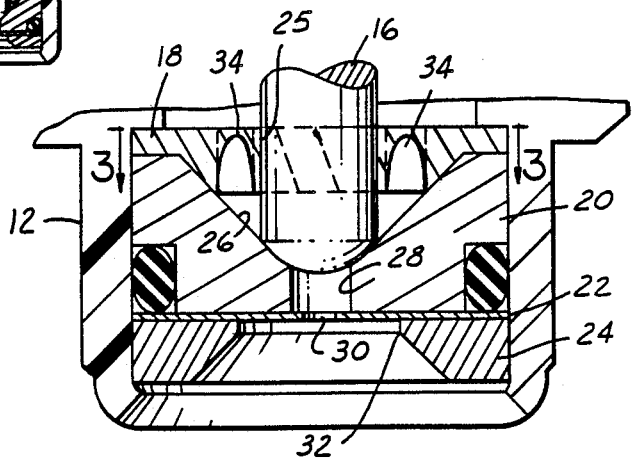
FIG. 2 is an enlarged sectional view of the nozzle end of the injector with skewed holes.
Figure 8:
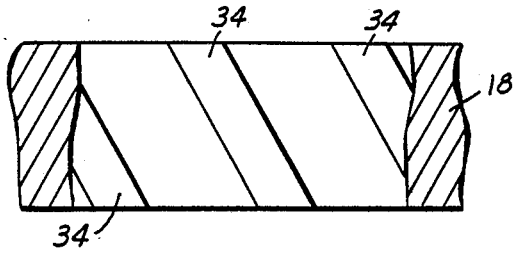
FIG. 8 is a developed view taken along arrows 8—8 in FIG. 6.

FIG. 1 depicts a fuel injector 10 whose nozzle 12 is constructed in accordance with the present invention. The injector comprises an inlet 14 at the end opposite nozzle 12. Fuel passes through the injector from inlet 14 to nozzle 12. The injector further includes a needle 16 that is operated by a solenoid 17 to control the passage of fuel from nozzle 12. FIG. 2 shows the nozzle in greater detail.

Axially captured within the nozzle end of the injector are, in order from upstream to downstream, a needle guide member 18, a valve seat member 20, a thin orifice disc member 22, and a retainer member 24. Needle guide member 18 contains a central circular hole 25 that guides needle 16 for axial motion toward and away from a frusto-conically shaped seat 26 centrally located in the upper face of seat member 20. Seat 26 leads to a circular hole 28 that is concentric with the seat. A circular orifice 30 in thin orifice disc member 22 is coaxial with hole 28. Retainer member 24 contains a flared hole 32 that is sized so as not to interfere with the fuel that is emitted from orifice 30. FIG. 2 shows the condition with solenoid 17 de-energized so that the rounded tip of needle 16 seats on seat 26 to close hole 28. When the solenoid is energized, the needle unseats from the seat to open the hole Member 18 is provided with fuel passage holes 34 that enable fuel to pass through it. These holes are spaced radially outwardly of hole 25. In accordance with principles of the invention, holes 34 are skewed to the injector axis so that when fuel passes through them, a circumferential, or angular, component of motion, i.e. swirl, is imparted to the fuel. FIGS. 3 and 4 illustrate further details of member 18. Holes 34 are straight but are skewed to the injector axis. The length, diameter, angle of skew and the number of holes are factors that are important in attaining a satisfactory design. The number of fuel passages are chosen to be the minimum number to give reasonably homogeneous angular velocity. For a given hole length, more holes give a more homogeneous angular velocity, but since the total hole area increases if the total number of holes is increased, a larger number of holes mandates that hole diameter be reduced to maintain the cone angle of the fuel spray. Small holes are less economical to produce. Test results have shown that for most four-stroke automotive engines four holes are the appropriate number. Failure to observe the need to keep the total hole area under control will result in either too much swirl and a very wide cone angle, or too little swirl and an extremely narrow or ineffective cone. A balance must be struck between cone angle and hole size, together with hole angle.

Another factor that influences cone angle is the length to diameter ratio of the holes. A very small length to diameter ratio (approaching unity) will reduce cone angle significantly. There is no optimum ratio, since the only objective is the cone angle. Generally, the steeper (or smaller) the hole angle, the easier the holes are to make, and this produces a shorter hole for a given design of member 18. Alternately, since a shorter hole produces less swirl, the hole angle will need to be increased to achieve a given cone angle as compensation for being too short.

It is also important to minimize the volume of fuel that is trapped between members 18 and 20 when needle 16 seats on seat 26 to close hole 28. It can be seen in FIG. 2 that member 18 is designed to do this. The member is shaped with a formation that fits into the upper portion of the depression forming seat 26. During operation of the injector, the fuel that is below member 18 has residual angular momentum from its passage through holes 34. This is true even for fuel that is below the seat and in the exhaust, or sack, volume. This will have the effect of keeping a small amount of fuel in the sack volume rather than allowing it to drip out after injection is complete. This small amount will be smaller than a conventional thin orifice injector because this outer layer of fuel will be displaced through the thin orifice by the angular momentum of the inner fuel.

A certain amount of fuel may flow between needle 16 and the wall of hole 25. This fuel will not have swirl and must be controlled. By combining the needle guide function with the swirl function in the one piece, member 18, precision operations are conducted on a single piece and tolerance stack-ups that might otherwise occur are avoided.

Further advantages of the invention are that the injector is less sensitive to injector aiming; fuel that ricochets off an engine intake valve is generally of comparatively small particle size; fuel particles are generally more homogeneous; the effect of the sack volume is lessened; symmetry of spray is assured.

Figure 9:
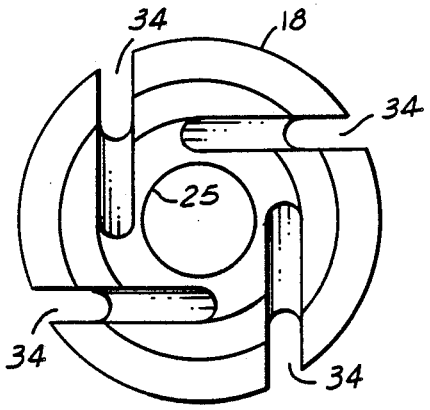
FIG. 9 is a top view of still another embodiment of one of the injector parts.

FIGS. 5, 6, 7, and 8 illustrate a further embodiment of member 18 in which the holes 34 are in the form of three spiral rectangular slots that are contiguous with guide hole 25. FIG. 9 shows still another embodiment in which member 18 is a powdered metal part in which the holes 34 are straight channels that are open to the circumferentially outer edge of the member.

While a preferred embodiment of the invention has been disclosed, principles are applicable to other embodiments.

What is claimed is:

1. In a fuel injector which comprises an injector body having a fuel passage that extends axially of the injector body to a nozzle at which fuel is emitted, said nozzle comprising a seat member having an upper face and a lower face, a frusto-conical depression formed in a central region of said seat member's upper face, a hole that extends from the bottom of said depression to the lower face of said seat member, said fuel injector comprising a needle that is reciprocated axially within said fuel passage by a mechanism that includes a solenoid, said needle having a tip end that seats on and unseats from the bottom of said depression to close and open said hole, a needle guide member that is affixed to the upper face of said seat member and comprises a central hole through which said needle passes for guiding said needle into seating on the bottom of said depression, said needle guide member further comprising fuel passage holes that extend through the needle guide member to convey fuel past the needle guide member, and a thin disc orifice member downstream of said seat member comprising metering orifice means for metering fuel emitted by the injector when the needle is unseated from the bottom of said depression, the improvement which comprises said needle guide member comprising a formation that fits into an upper portion of said seat member depression, said formation having a lower face within said seat member depression, wherein said fuel passage holes of said needle guide member have their outlets at the lower face of said formation and wherein said fuel passage holes of said needle guide member are skewed to the injector axis so that a circumferential component of motion is imparted to fuel that has passed through said fuel passage holes of said needle guide member before the fuel passes through said metering orifice means of said thin disc orifice member.

2. The improvement set forth in claim 1 wherein said fuel passage holes are spaced radially outwardly of said central hole in said needle guide member.

3. The improvement set forth in claim 1 wherein said fuel passage holes are contiguous with said central hole in said needle guide member.

4. The improvement set forth in claim 1 wherein said fuel passage holes are formed by channels that are open to the outer circumferential edge of the needle guide member.

* * * * *